US012728972B2

(12) United States Patent
Cheng

(10) Patent No.: US 12,728,972 B2
(45) Date of Patent: Sep. 8, 2026

(54) ROWING DEVICE AND ON-WATER PADDLING TRANSPORTATION EQUIPMENT USING THE SAME

(71) Applicant: Lok Chi Cheng, Kowloon (HK)

(72) Inventor: Lok Chi Cheng, Kowloon (HK)

( * ) Notice: Subject to any disclaimer, the term of this patent is extended or adjusted under 35 U.S.C. 154(b) by 512 days.

(21) Appl. No.: 18/203,851

(22) Filed: May 31, 2023

(65) Prior Publication Data

US 2024/0400182 A1 Dec. 5, 2024

(51) Int. Cl.
*B63H 16/067* (2006.01)
*B63H 16/073* (2006.01)
*B63H 16/18* (2006.01)

(52) U.S. Cl.
CPC ..... *B63H 16/067* (2013.01); *B63H 16/073* (2013.01); *B63H 16/18* (2013.01)

(58) Field of Classification Search
CPC ..... B63H 16/00; B63H 16/02; B63H 16/04; B63H 2016/043; B63H 2016/046; B63H 16/06; B63H 2016/063; B63H 16/067; B63H 16/073; B63H 2016/085; B63H 16/10; B63H 16/105; B63H 16/12; B63H 16/14; B63H 16/18; B63H 16/202
USPC ..... 114/343, 347, 363, 364; 440/21, 25, 32, 440/101, 102, 104, 105, 106, 107, 108, 440/109, 110
See application file for complete search history.

(56) References Cited

U.S. PATENT DOCUMENTS 5,647,782 A * 7/1997 Henry ..... B63H 16/105 440/102
6,939,186 B1 * 9/2005 Kuckes ..... B63H 16/107 440/102
2005/0070181 A1 * 3/2005 Bleicken ..... B63H 16/02 440/104

* cited by examiner

*Primary Examiner* — Daniel V Venne

(57) ABSTRACT

The present disclosure is a forward-facing rowing mechanical device for on-water paddling transportation equipment. The device is comprised of a novel mechanism which re-diverts effort from legs of the rower to the opposite direction. Therefore, the water propelling direction is changed by the mechanism from backward driving to forward driving. The device includes a backbone; a seat on top of the backbone; a sliding rigger carrying oars; a foot plate for receiving effort from the rower; the effort diverting mechanism for changing driving direction and other necessary peripheral parts.

15 Claims, 7 Drawing Sheets

ROWING DEVICE AND ON-WATER PADDLING TRANSPORTATION EQUIPMENT USING THE SAME

FIELD OF THE INVENTION

The present disclosure relates to the field of on-water paddling transportation equipment provided with the same.

BACKGROUND

There are different types of on-water paddling transportation equipment using oar for driving such as kayak, canoe, rowing, and stand-up paddling. Among the equipment, rowing works out the highest efficiency with the help of the long oar and effort by legs of the rower. Rowers can perform long cruising range and speedy movement. But why rowers sit backward looking to their port of departure instead of sitting forward looking to their destination?

The reason is the sliding seat which was invented in the mid-1800s. Before that, rowers used only arms to drive. Sitting backward or forward was up to the rower. If a rower sits forward, he/she has to arm push the oars. If a rower wants to sit backward, he/she then arms pull the oars.

The sliding seat has greatly improved power of stroke by leg action on top of arm action. However, to sweep oars with a sliding seat, the seat has to slide from rear to front of a boat and so rowers have to sit facing backward.

Mechanisms using effort from leg for forward rowing are not new. Few manufacturers nowadays are still using the forward rowing arrangement from the late 1800s, such as that shown in FIG. 11. The special oar SO has 2 halves moving in the opposite direction at the pivot point. Because of using special oar, prices of such mechanisms are high. While other forward systems work with very different stroke action from the conventional rowing. Rowers will act like driving a machine rather than they are doing rowing. For these reasons, most of the forward systems have not been popularized successfully.

No one prefers to sit backward and keeps their head turning back. Rowing participants want to be safe and enjoy the sense forward. This invention can address drawbacks of the existing forward systems and brings rowers an affordable, much safer and more enjoyable paddling experience.

This device can be used for such as racing, recreation, coastal, cruiser boat and rescue boat etc. It can be used for sweep rowing and sculling, single or multiple player.

SUMMARY OF THE INVENTION

The purpose of the present disclosure is to provide a novel forward-facing rowing mechanical device for on-water paddling transportation equipment.

The device has the design aspects:

1. The device is comprised of 5 major components: the backbone; the effort transmission and diverting device (ETDD); the seat; the foot plate and the sliding rigger and other necessary peripheral parts.
2. The seat is fixed on the rear top of the device.
3. The foot plate is sliding and connected to the ETDD. It drives the sliding rigger via the ETDD.
4. The foot plate drives the sliding rigger to slide forth and back when the rower applies effort to it. The oars installed on the sliding rigger propel water by movement of the sliding rigger when the rower plays a stroke action.

5. The sliding rigger always slides to the opposite direction of the movement of the foot plate. The sliding rigger always slides synchronously as the foot plate is sliding.
6. The backbone is a skeleton structure and featured with slide-ways. It provides mounting feature as well for installation onto on-water paddling transportation equipment.

With the design aspects stated above, the device facilitates the following benefits:

1. The rower sits facing forward, can keep looking at the path forward. That is a much safer way than the conventional backward system.
2. The way to operate the device is the same as conventional rowing systems (backward facing sliding seat systems or backward facing sliding rigger systems). Therefore it gives the same mechanical efficiency as the conventional rowing systems.
3. With the way of operation, existing rowers can pick up this novel forward system easily and instantly.
4. Because of the skeleton structure of the backbone, it can be adapted easily on most of the existing on-water paddling transportation equipment.
5. A standard rowing oar is as long as 2.9 meters. It is made of carbon fibre. So oars are always expensive. This invention uses standard oars instead of special oars. Current rowing participants can invest only cost for this device as an alternative system and keep using their own standard oars and their existing on-water paddling transportation equipment. It makes this invention a greater chance of being popularized.
6. With the fixed seat, rowers do not need to adjust seat position for difference of rower's height. So no additional device length is required for seat position adjustment. The overall length of the device has been minimized and that maximizes suitability for existing on-water paddling transportation equipment. Again, it makes this invention a greater chance of being popularized.
7. With a fixed seat design, the centre of gravity will not shift as in conventional sliding seat or sliding rigger systems. Boat bow and stern (boat's front and rear) do not pitch up and down. That avoids efficiency loss due to water resistance fluctuation.

BRIEF DESCRIPTION OF THE DRAWINGS

In order to illustrate the present disclosure more clearly, a brief introduction of relevant accompanying drawings are given below. It should understood that these drawings are provided only to illustrate some embodiment of the present disclosure, and many other technical features or connections can be obtained by those of ordinary skill in the art based on these drawings.

DESCRIPTION OF EXEMPLARY EMBODIMENTS OF THE INVENTION

An embodiment of the present disclosure is described below with reference to the drawings. It should be understood, however, the invention is not limited to the arrangements, structures, mechanisms, materials or the manufacturing methods shown.

Structure

Figure 1:
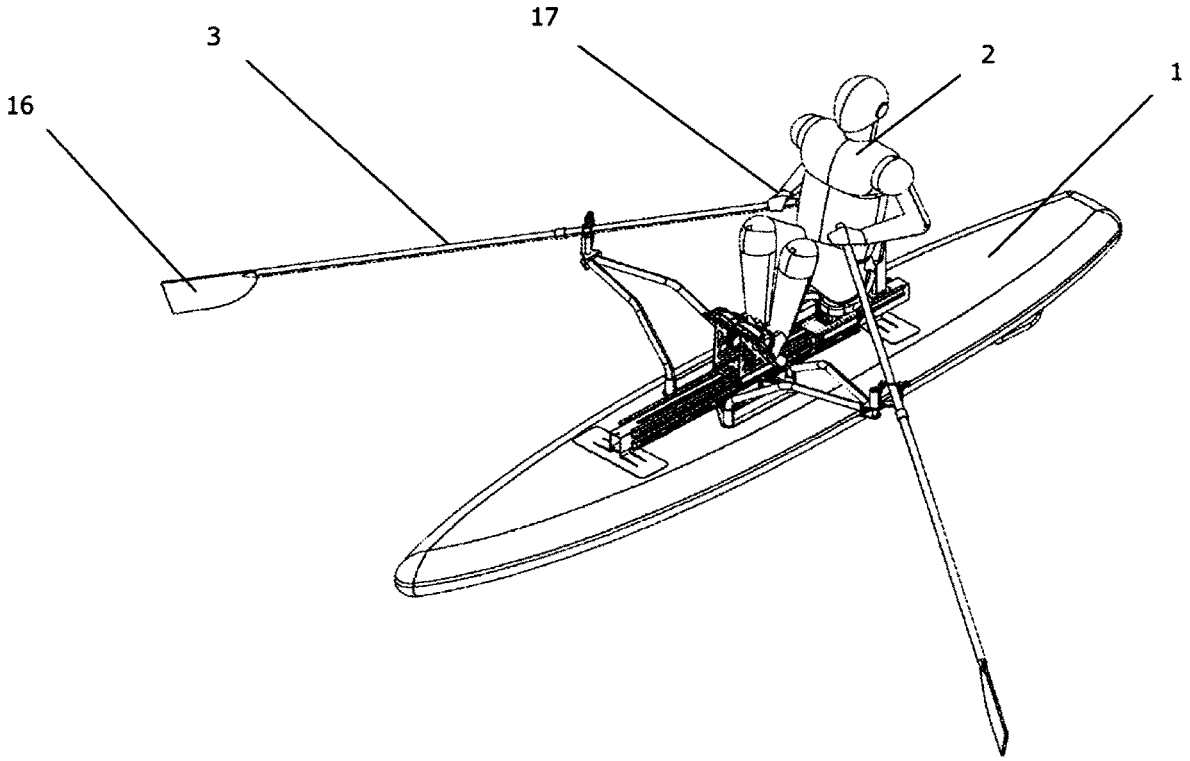
FIG. 1 is an over view of the device with two oars installed and a rower sitting on an on-water paddling transportation equipment.
Figure 2:
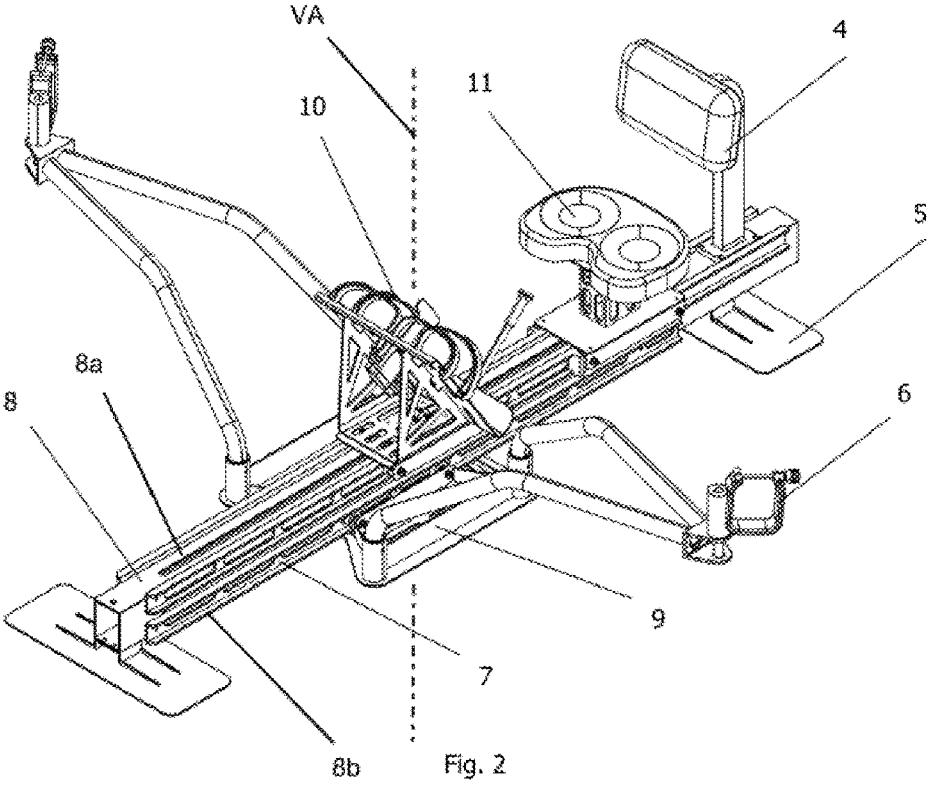
FIG. 2 is an over view on the device.

In this embodiment, the complete device as FIG. 2 is built to a single skeleton structure. All components are assembled into the backbone 8 as shown in FIG. 2. That facilitates easy installation and high suitability to be adapted on the existing on-water paddling transportation equipment.

Most of the components are made of light weight material such as aluminium alloy. The major parts can be manufactured by metal extrusion molding process which facilitates low manufacturing cost. That makes the device a greater chance of being popularized successfully.

The overall length and height of the device is designed to be similar as existing on-water paddling equipment and so it has high suitability for the existing on-water paddling transportation equipment.

The device uses standard oars 3 from the market. Existing rowing participants can invest only on the device as alternative system and keep using their own oars and on-water transportation equipment.

The Backbone

The backbone 8 (which also may be referred to as an elongated backbone) is a frame for all the parts and components to be assembled on.

The length of the backbone 8 is below 2 meters which is relatively a short length. The device has high suitability to be adapted on the existing on-water padding transportation equipment.

Slide-ways 7 are featured on the backbone 8. The foot plate 10 (which also may be referred to as a sliding foot plate) is fitted on top of the backbone 8. The foot plate 10 slides along a longitudinal direction of the backbone 8. The sliding rigger 9 is fitted underneath the backbone 8. The sliding rigger 9 slides along a second side 8*b* of a backbone 8, along a longitudinal direction of the backbone 8. As shown in FIG. 2, the sliding rigger 9 and the sliding foot plate 10 are movable relative to the backbone 8 to be alignable along a vertical axis VA, which is normal to the longitudinal direction of the backbone 8. The seat 11 is fitted on top rear of the backbone 8 to extend upwardly from a first side 8*a* of the backbone 8. The ETDD 12 is fitted inside the backbone 8. Mounting feet 5 to on-water transportation equipment are provided at front end and rear end bottom of the backbone 8.

The ETDD

Figure 10:
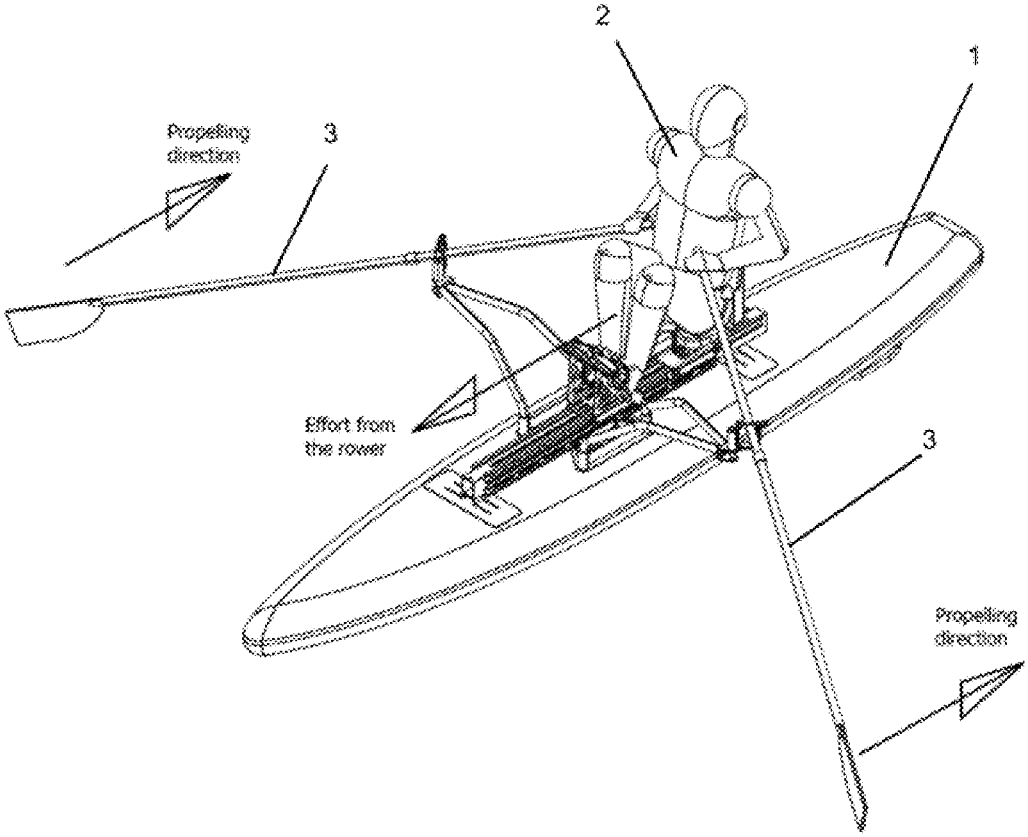
FIG. 10 shows the transmission of effort from the rower to the oars via the sliding rigger.
Figure 11:
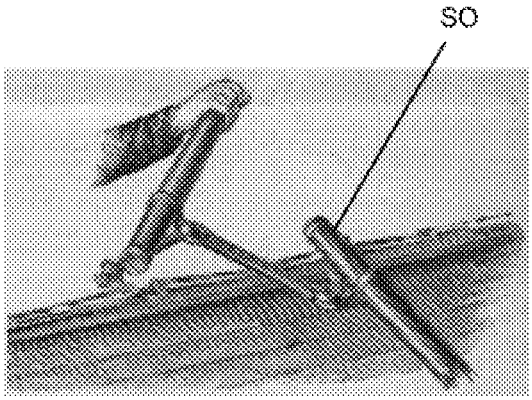
PRIOR ART Fig. 11
FIG. 11 shows the forward rowing system invented by W. Lyman in the late 1800's.

The function of the ETDD 12 is to transmit effort from the rower 2 to the oars 3 via the sliding rigger 9, as shown in FIG. 10. It also facilitates the opposite and synchronous movement stated. The technology of force transmission is by mean of belt 13 in this embodiment. However, it can be also by mean of other technologies such as gears, chains, rotary rods and levers.

The ETDD 12 is fitted inside backbone 8. A belt 13 is used as a ETDD 12 in this embodiment. The foot plate 10 is connected to the top of the belt 13 by meaning by mechanical fastener or clamp while the sliding rigger 9 is connected underneath of the belt 13 by mechanical fastener or clamp.

There are two bearings and pulleys 14 used in the ETDD 12. Two shafts 15 are for adapting ETDD 12 to the backbone 8.

When the foot plate 10 is forced to slide by effort from the rower 2 and it is connected to the belt 13, the foot plate 10 drives the belt 13 to turn. As the rigger 9 is connected to the belt 13 as well, the sliding rigger 9 is forced to slide synchronously. As the foot plate 10 is connected to the top of the belt 13 while the rigger 9 is connected underneath of the belt 13, the sliding rigger 9 slides to the opposite direction.

The belt can be made of fibre reinforced rubber.

The Foot Plate

The foot plate 10 is connected to the ETDD 12. It receives effort from the rower 2 and transmits the effort to the sliding rigger 9 via the ETDD 12.

The foot plate 10 is fitted on top of the backbone 8. The foot plate 19 slides along longitudinal direction of the backbone 8.

The foot plate 10 is made of light weight material such as aluminium alloy. Rollers 18 are featured under for sliding movement.

The Sliding Rigger

The sliding rigger 9 is connected to the ETDD 12. It further transmits effort from the ETDD 12 to the oars 3. It is featured a pair of oar lock 6 as pivot point for the oars 3.

The sliding rigger 9 is driven by the foot plate 10. The sliding rigger 9 and the foot plate 10 slide synchronously. It always moves to the opposite direction of the foot plate 10.

The sliding rigger 9 is fitted underneath of the backbone 8. The sliding rigger 9 slides along longitudinal direction of the backbone 8.

The sliding rigger 9 is made of light weight material such as aluminium alloy. Rollers 18 are featured under for sliding movement.

The Seat

The seat 11 is fixed on rear top of the backbone 8 in this embodiment. It supports the rower 2 to being a sat posture in the position at the rear top of the device.

Figure 3:
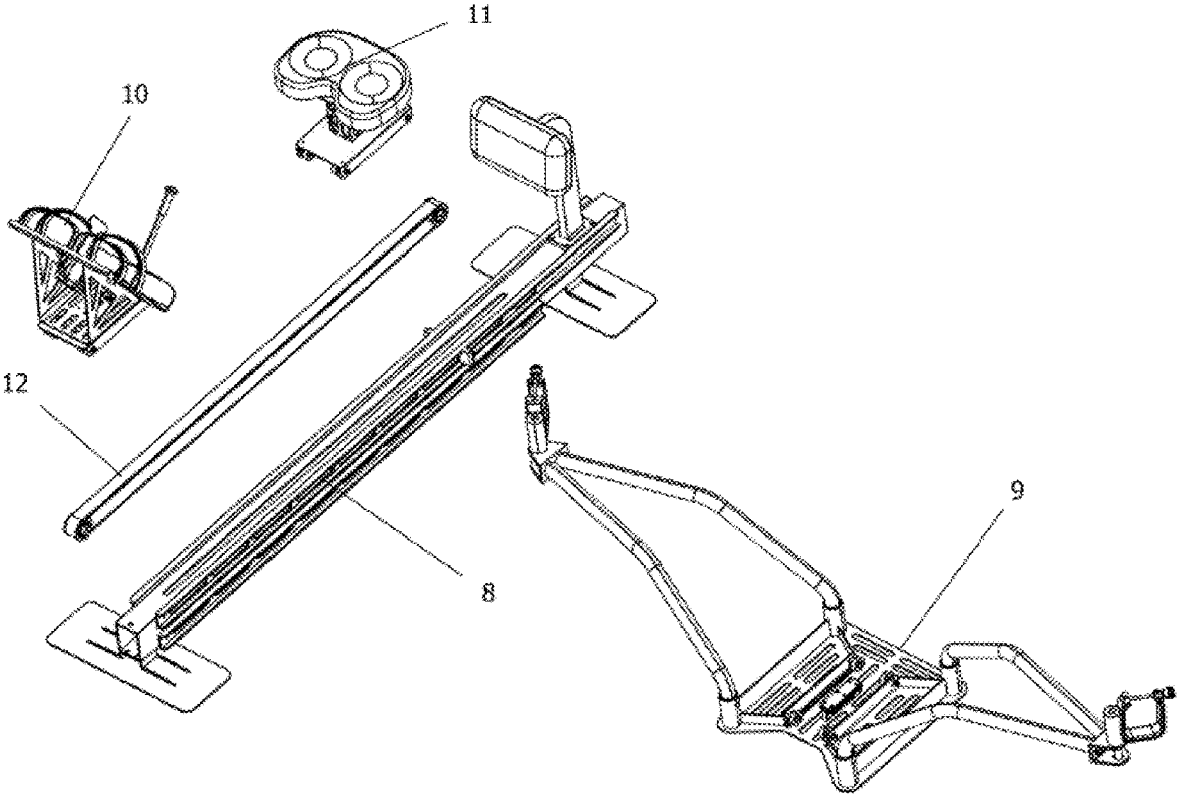
FIG. 3 is an exploded view on the device to show the 5 major components.
Figure 4:
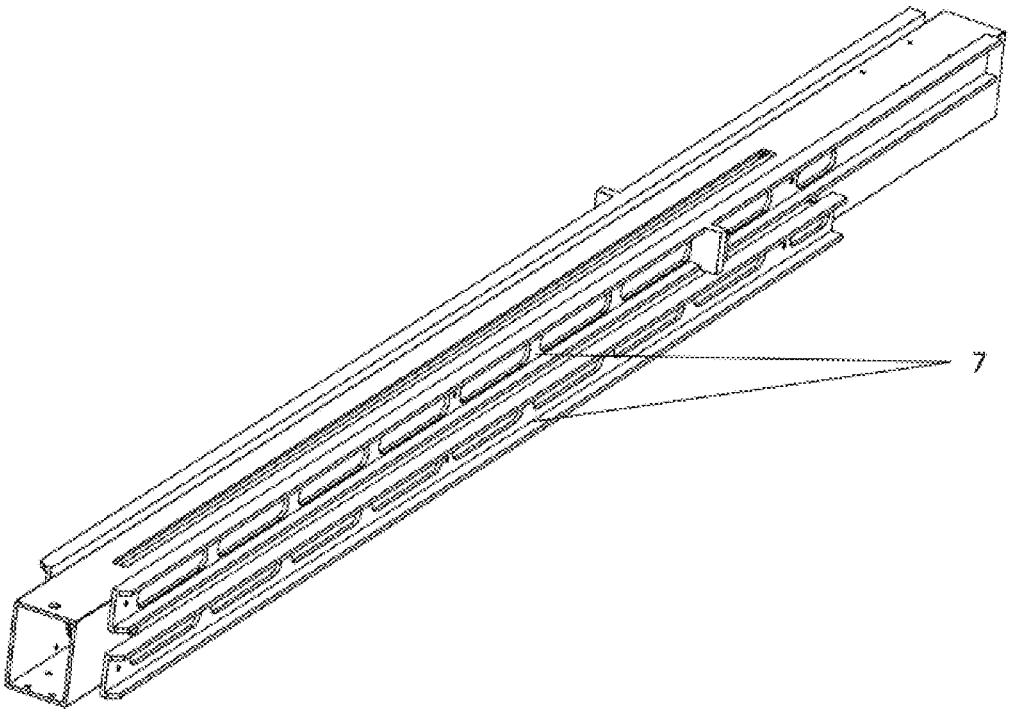
FIG. 4 is a schematic structural view of the backbone.
Figure 5:
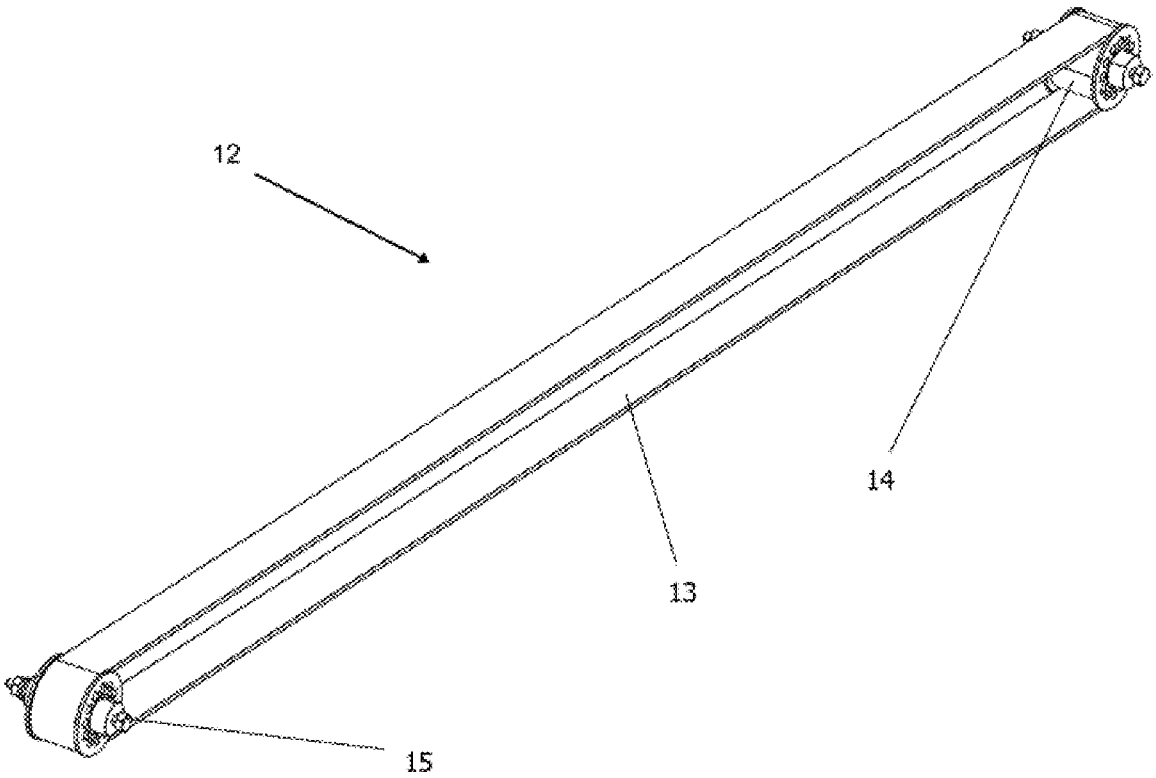
FIG. 5 is a schematic structural view of the ETDD.
Figure 6:
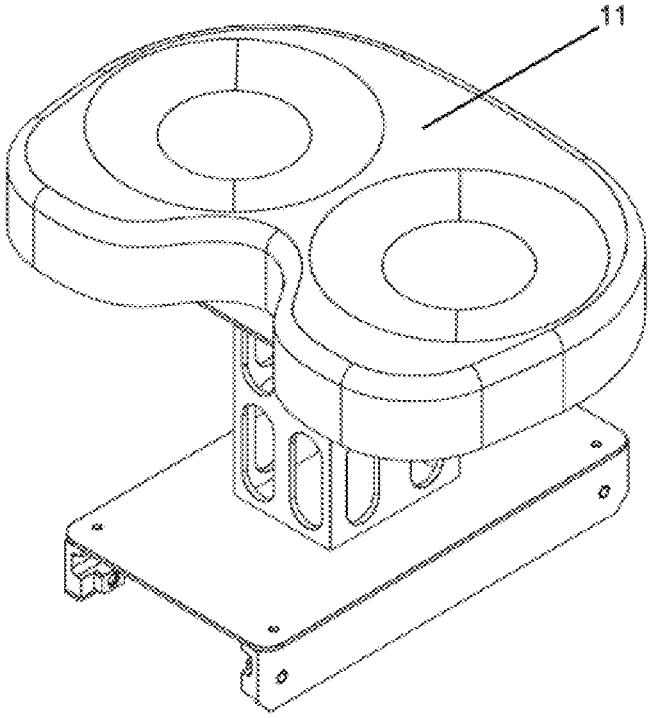
FIG. 6 is a schematic structural views of the seat.
Figure 7:
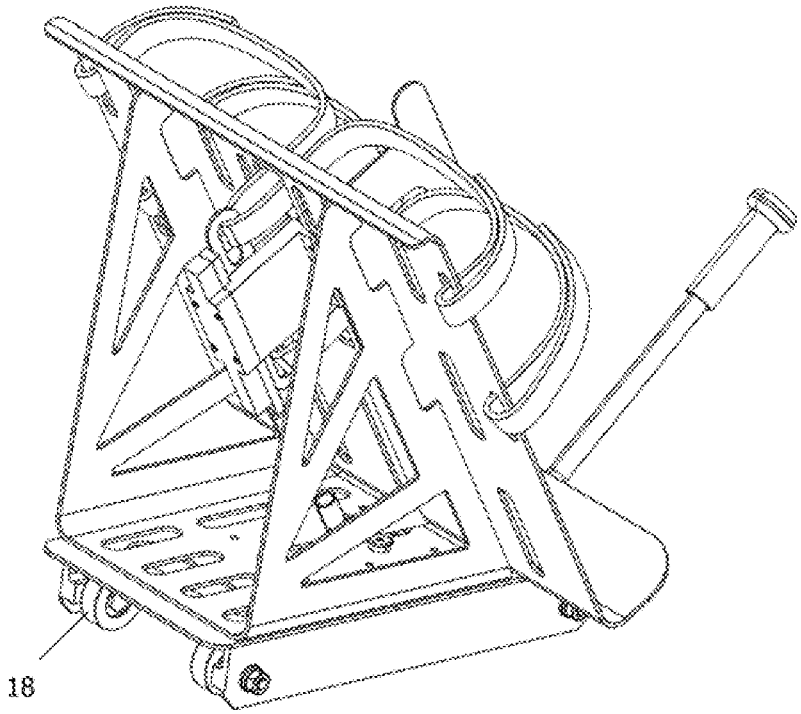
FIG. 7 is a schematic structural view of the foot plate.
Figure 8:
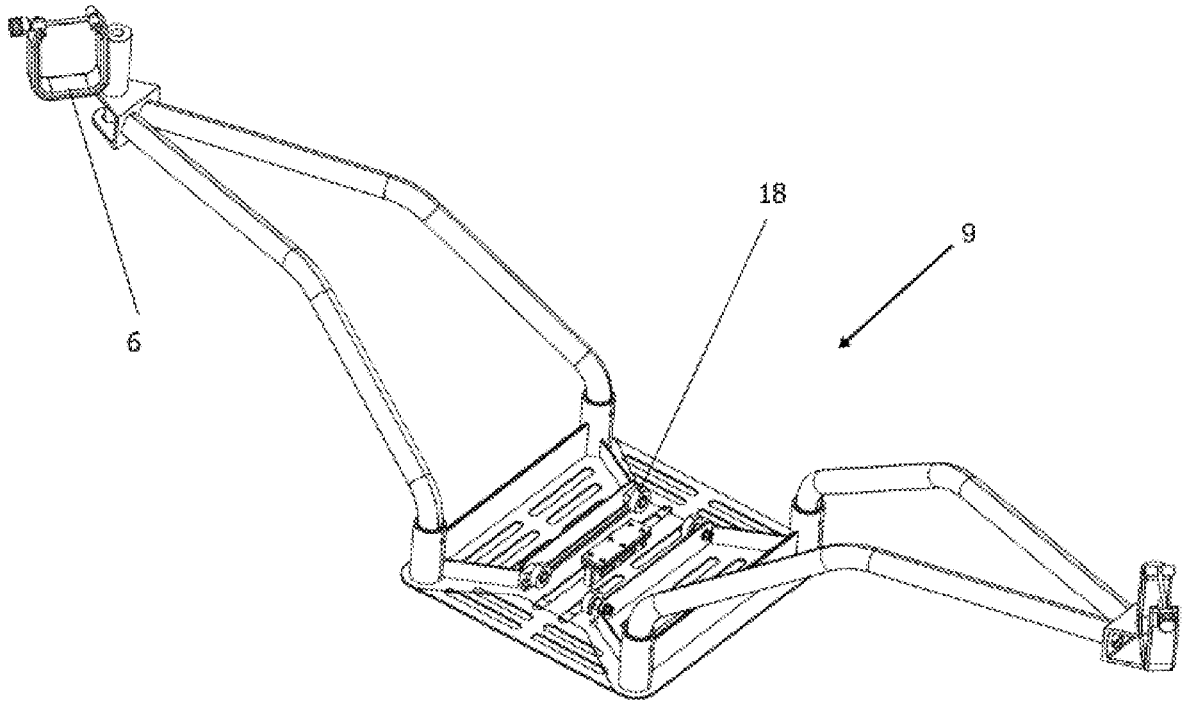
FIG. 8 is a schematic structural view of the sliding rigger.

The seat 11 can be used with a back support 4 as shown in FIG. 3 which helps for firm and comfortable sitting posture during stroke. When the rower 2 wants a further sweep angle on top of sweep angle by leg and arm action, the rower 2 can lean him/her torso forward at the end of a stroke. The back support 4 makes leaning torso forward easier as it share some loading on the abdomen muscles.

The seat 11 is made of light weight material such as aluminium alloy.

Operation

Figure 9:
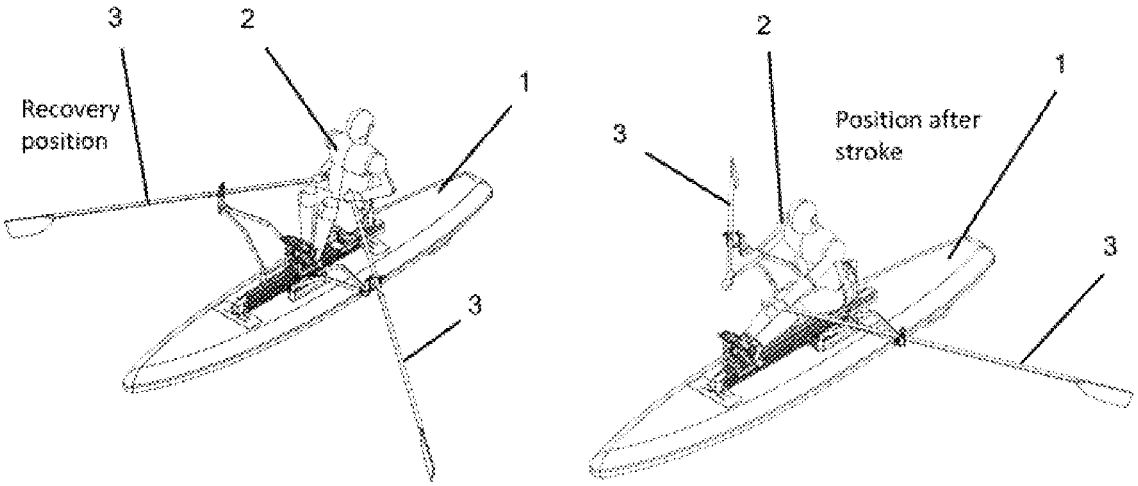
FIG. 9 are views on position before a stroke (the recovery position) and position after a stroke. The figure left hand side (LHS) is the view of the recovery position. The figure right hand side (RHS) is a view of position after a stroke.
Figure 12:
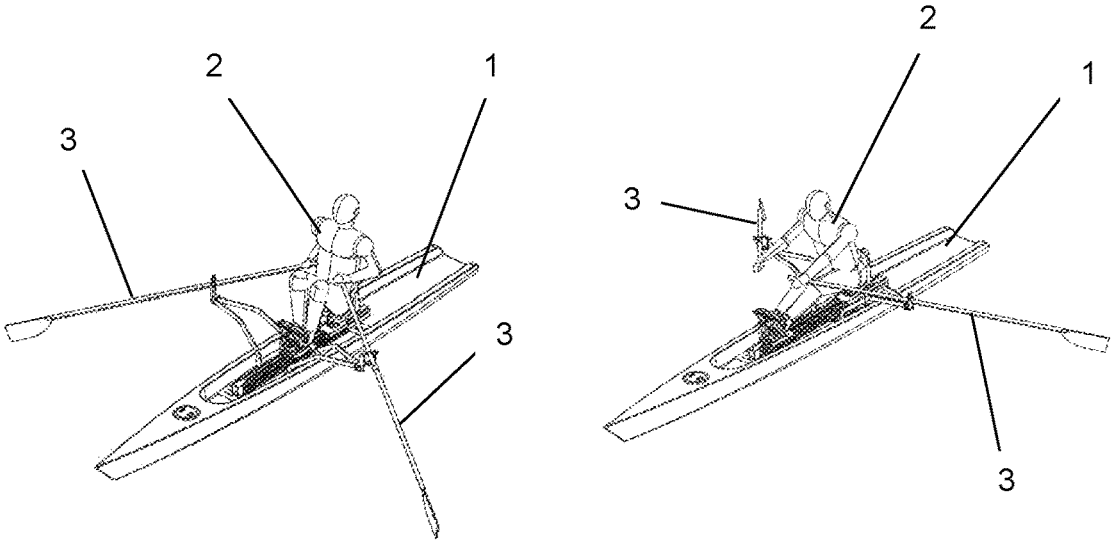
FIG. 12 are views of a sculling boat on position before a stroke (the recovery position) and position after a stroke. The figure left hand side (LHS) is the view of the recovery position. The figure right side (RHS) is a view of position after a stroke.
Figure 13:
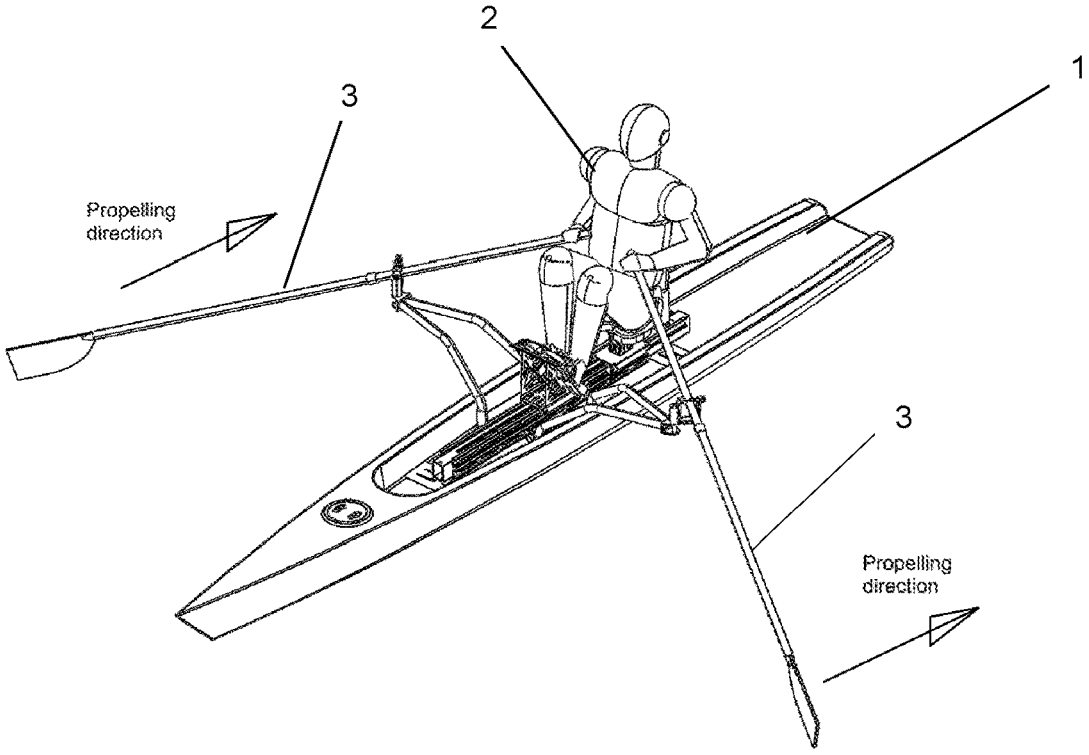
FIG. 13 shows the transmission of effort from the rower to the oars via the sliding rigger of a sculling boat.

In this embodiment, the device should be installed on an on-water paddling transportation equipment by mean of such as mechanical fasteners, lashing straps or welding up to construction of the on-water transportation equipment being used. The on-water paddling transportation equipment includes a body 1, which may be in the form of a rowing boat, a sculling boat (FIGS. 12-13), or a board (FIGS. 9-10). Oars 3 are installed into the oar-lock 6 on the sliding rigger 9.

The rower 2 sits on the seat 11. Feet are tied on the foot plate 10 by means of straps. The rower's arms are flexed. His/her hands hold the oar grips 17 and get close to lower chest. His/her feet are bent and knees get close to torso. Oar blade 16 of oars 3 are above water. The oar blades 16 are at front position. The foot plate 10 is at the rear position while the sliding rigger 9 is at the front position. That is the position and posture of "recovery", the position and posture ready for a stroke action, figure LHS of FIG. 9.

The rower 2 then performs a stroke. Wherein hands move upward to sink the oar blades 16 down into the water. The rowers' legs stretch rapidly to push off the foot plate 10 toward front. The sliding rigger 9 is so driven toward rear via the ETDD 12. Finally the rower's arms push oar grips 17 forward and his/her torso leans forward the front for further sweep angle as figure RHS of FIG. 9.

After a stroke, the rower's hands move down to lift the oar blades 16 out of the water. Then the rower 2 goes back to the recovery position.

What is claimed is:

1. A forward-facing rowing mechanical device for on-water paddling transportation equipment, comprising:

an elongated backbone with slide-ways;

a seat fixed to the elongated backbone to extend upwardly from a first side of the elongated backbone;

an effort transmission and diverting device (ETDD) arranged along the elongated backbone;

a sliding rigger connected to the ETDD, wherein the sliding rigger is movably connected to the elongated backbone to slide along a second side of the elongated backbone, the second side facing away from the first side, the second side being spaced from the first side along a vertical axis; and a sliding foot plate connected to the ETDD and configured to receive effort applied by a rower, wherein the sliding foot plate is movably connected to the elongated backbone to slide along the first side of the backbone, wherein, the sliding rigger and the sliding foot plate are movable relative to the elongated backbone to be alignable along the vertical axis, and wherein, both the sliding foot plate and the sliding rigger are configured to synchronously move in opposite directions by means of the ETDD in response to effort applied by the rower to the sliding foot plate.

2. The forward-facing rowing mechanical device of claim 1, wherein the sliding foot plate actively drives the sliding rigger to slide forth and back when the rower applies effort to conduct a synchronous movement in a slave way resulting in the sliding foot plate and the sliding rigger synchronously moving back and forth in opposite directions at a same speed.

3. The forward-facing rowing mechanical device of claim 1, wherein the sliding rigger always slides to the opposite direction of a sliding direction of the sliding foot plate.

4. The forward-facing rowing mechanical device of claim 1, wherein the sliding rigger always slides synchronously as the sliding foot plate.

5. The forward-facing rowing mechanical device of claim 1, wherein the rower sits facing toward to a destination.

6. The forward-facing rowing mechanical device of claim 1, wherein the ETDD includes a belt.

7. A boat or a board or other on-water paddling transportation equipment comprising a body, and the forward-facing rowing mechanical device as claimed in claim 1 mounted to the body.

8. The boat or a board or other on-water paddling transportation equipment of claim 7, wherein the body is a sculling boat.

9. The boat or a board or other on-water paddling transportation equipment of claim 7, wherein the body is a board.

10. The forward-facing rowing mechanical device of claim 6, wherein the belt is connected to both the sliding foot plate and the sliding rigger.

11. The forward-facing rowing mechanical device of claim 6, wherein the belt is located within the elongated backbone.

12. The forward-facing rowing mechanical device of claim 1, wherein the ETDD includes a continuous loop.

13. The forward-facing rowing mechanical device of claim 12, wherein the continuous loop is connected to both the sliding foot plate and the sliding rigger.

14. The forward-facing rowing mechanical device of claim 12, wherein the continuous loop is located within the elongated backbone.

15. The forward-facing rowing mechanical device of claim 12, wherein the ETDD includes two spaced-apart pulleys about which the continuous loop extends.

* * * * *